US005206659A

United States Patent [19]

Sakurai et al.

[11] Patent Number: 5,206,659

[45] Date of Patent: Apr. 27, 1993

[54] THERMAL INK-JET PRINTHEAD METHOD FOR GENERATING HOMOGENEOUS NUCLEATION

[75] Inventors: Kikukazu Sakurai; Mitsuo Tsuzuki, both of Tokyo, Japan

[73] Assignee: NEC Corporation, Tokyo, Japan

[21] Appl. No.: 670,103

[22] Filed: Mar. 15, 1991

[30] Foreign Application Priority Data

Mar. 15, 1990 [JP] Japan ..... 2-66407

[51] Int. Cl.[5] ..... B41J 2/05

[52] U.S. Cl. ..... 346/1.1; 346/140 R

[58] Field of Search ..... 346/140, 1.1

[56] References Cited

U.S. PATENT DOCUMENTS 4,339,762 7/1982 Shirato ..... 346/140

4,490,728 12/1984 Vaught ..... 346/140 X 4,723,129 2/1988 Endo ..... 346/140 X 4,847,630 7/1989 Bhaskar ..... 346/140 R X 4,935,752 6/1990 Hawkins ..... 346/140

FOREIGN PATENT DOCUMENTS 61-59914 2/1986 Japan .

*Primary Examiner*—Joseph W. Hartary

*Attorney, Agent, or Firm*—Sughrue, Mion, Zinn, Macpeak & Seas

[57] ABSTRACT

A thermal ink-jet type printhead is disclosed which comprises a strip-like thin metallic layer formed on a substrate. The layer is configured so as to define a narrow portion which is positioned between broad portions. The narrow portion defines a heating element which is integral with the broad portions which act as electrodes. Electrical heating pulses are supplied to the narrow heater portion via the electrodes. The heater arrangement is durable to thermal stresses generated by a superheating and, accordingly is well suited for spontaneous or homogeneous nucleation.

2 Claims, 6 Drawing Sheets

THERMAL INK-JET PRINTHEAD METHOD FOR GENERATING HOMOGENEOUS NUCLEATION

BACKGROUND OF THE INVENTION

1. Field of the Invention

The present invention relates to a thermal ink-jet printhead with an improved heater arrangement and a method of generating homogeneous or spontaneous nucleation using the heater arrangement.

2. Description of the Prior Art

Ink-jet printing technologies have been developed and there are several printers on the market which successfully employ the sudden growth of a vapor bubble to eject a minute droplet of ink toward a sheet of paper or the like. Ink-jet recording features inherently quiet printing in that nothing strikes a paper except the ink.

One of conventional ink-jet recording technologies is disclosed in Japanese Patent Application No. 53-101189 which was published for opposition purposes on Dec. 18, 1986 under publication No. 61-59914. The above-mentioned Japanese Patent Application was filed in the United States claiming Convention Priority under U.S. Ser. No. 827,489, which was granted Feb. 2, 1988 and assigned U.S. Pat. No. 4,723,129. This known technique is characterized by a multi-orifice ink-jet printhead with a simple structure and a high-speed recording on a plain paper.

Before turning to the present invention it is deemed advantageous to briefly discuss a known printhead arrangement which is disclosed in the above-mentioned Japanese patent application with reference to FIGS. 1 to 4.

FIG. 1 is a partially sectioned view showing an internal structure of an ink-jet printhead 10. A heat-generating resistor or heating element 12 is provided on a heat accumulating layer 14 which has been evenly deposited on a substrate (viz., base plate) 16 through the use of evaporation, plating or the like technique. Electrodes 18, 20 are coupled to the heating element 12 and apply electrical currents thereto. The heating element 12 and the electrodes 18, 20 are covered with a protective layer 22. According to the description in the above-mentioned U.S. Pat. No. 4,723,129, the protective layer 22 is to prevent electric leaking from one of the electrodes (18 or 20) to the other through a liquid 24 and/or to prevent the elements 12, 18 and 20 from being contaminated by the liquid 24.

An ink supply chamber 26 is formed by a cover plate 28, a chamber lid 30 and the substrate 16. The ink supply chamber 26 communicates with each of a plurality of nozzles (only one is shown in the drawing and is designated by reference numeral 32) which is defined between the substrate 16 and the cover plate 28. Each of the nozzles communicates with an ink supply pipe (not shown).

The aforesaid prior art makes the use of film boiling for ejecting a droplet of ink, the thermal excitation mechanism of which has been discussed with reference to a boiling curve shown in FIG. 2.

In FIG. 2, "dT" on the abscissa indicates a temperature difference between a surface temperature Tr of the heating element 12 and a boiling temperature Tb of the liquid, while a heat flux "Et" transferred from the heating element 12 to the liquid 24 is represented by the ordinate. The boiling curve shows that sudden boiling is induced when the temperature difference dT exceeds a region A-B. Nuclei boiling occurs in a region B-C-D while film boiling takes place in a region E-F-G. As mentioned above, the prior art makes the use of film boiling, which occurs at a point E, by heating the liquid in the vicinity of the heating element 12 in the order of A→B→C→D→E. When the film boiling occurs, a film vapor is induced on the surface of the heating element 12 and prevents the heat transfer from the heating element 12 to the liquid surrounding the film vapor. Thus, the film vapor is volumetrically decreased due to adiabatic phenomenon and is forced to collapse at a high speed.

FIG. 3 is a close-up sectional view of the heating element 12 and the vicinities thereof of FIG. 2, while FIG. 4 is a sectional view taken along a section line X-X' of FIG. 3. The dimensions of each of the members of FIG. 3 are not precisely shown and, the thickness of the heating element 12 is in fact ten to fifty times that of each of the electrodes 18, 20. Such a large difference in thickness tends to cause undesirable cracks in the contacting portions 40 between the resistor 12 and the electrodes 18 and 20, due to the thermal stresses caused by repeated cycle of heating and cooling of the resistor (heating element) 12. More specifically, such undesirable cracks are caused by the differences of coefficients of linear expansions of the members 12, 18 and 20.

As referred to above, the prior art utilizes film boiling for ejecting a droplet of ink by heating along with the points A→B→C→D→E. This causes separation of ink from the heating surface at the point E, and thus the heat flux transition efficiency to the liquid abruptly drops. Accordingly, the surface temperature of the heating element 12 rises abruptly and hence a so-called dry-out phenomenon is induced on the surface of the heating element 12. Therefore, the prior art has encountered the drawback in that the heating element 12 is degraded due to the dry-out phenomena.

Film boiling is caused by heterogeneous nucleation due to very minute gas bubbles formed on the heater surface irregularities (scratches, fine cavities, for example). These gas bubbles are called nucleation sites. The heterogeneous nuclei are observed at an early stage of heating and grow relatively slowly and, accordingly, the prior art is inherently suffered from the difficulty that heat flux transition from the heater surface to an activated liquid layer formed just thereabove is insufficient.

SUMMARY OF THE INVENTION

It is an object of the present invention to provide an improved heater arrangement which overcomes the difficulties encountered in the above-mentioned prior art and hence is particularly suitable for thermal ink-jet printing applications.

Another object of the present invention is to provide an improved heater arrangement which is durable to extremely high heating applications and hence is well suited for thermal ink-jet printing using spontaneous or homogeneous nucleations.

Another object of the present invention is to provide a method by which the difficulties inherent in the above-mentioned prior art are overcome.

Still another object of the present invention is to provide a method which is well suited for spontaneous or homogeneous nucleation.

In brief, the above object is achieved by a method wherein a thermal ink-jet type printhead is disclosed which comprises a strip-like thin metallic layer formed on a substrate. The layer is configured so as to define a narrow portion which is positioned between broad portions. The narrow portion defines a heating element which is integral with the broad portions which act as electrodes. Heating electrical pulses are supplied to the narrow heater portion via the electrodes. The heater arrangement is durable to thermal stresses generated by super heating and, accordingly is well suited for spontaneous or homogeneous nucleation.

More specifically a first aspect of the present invention comes in a heater arrangement for use in a thermal ink-jet type printhead, comprising: a substrate; a thin metallic layer formed on said substrate, said thin metallic layer being configured so as to define a narrow portion which is located between broad portions, the narrow portion defining a heating element which is integral with the broad portions which act as electrodes via which currents are supplied to the narrow heater portion.

A second aspect of the present invention comes in a thermal ink-jet type print head which comprises: an orifice plate in which at least one orifice is formed; a substrate which is disposed adjacent the orifice plate in a manner to define a space in which ink can be supplied; a metallic layer formed on the surface of said substrate so as to be exposed to said space, said metallic layer defining integral heater element and electrodes, said heater element being configured such that the width of said heater element is narrower than the width of each of the electrodes.

A third aspect of the present invention comes in a method of operating a thermal ink-jet type print head which includes a substrate, a strip-like thin metallic layer formed on said substrate, said strip-like thin metallic layer being configured so as to define a narrow portion which is located between broad portions, the narrow portion defining a heating element which is integral with the broad portions which act as electrodes via which currents are supplied to the narrow heater portion, the method comprising the steps of: applying a current to the heating element in a manner to heat the same in a range from $10^{6°}$ to 10° C./sec as to transfer heat energy from the heating element to an ink at a rate of $10^7$ to $10^8$ MW/$m_2$ over a time period less than 10 μs and to achieve homogeneous nucleation via which a bubble of gas is produced and induces a droplet of ink to be ejected from a nozzle located adjacent the heating element.

BRIEF DESCRIPTION OF THE DRAWINGS

The features and advantages of the present invention will become more clearly appreciated from the following description taken in conjunction with the accompanying drawings in which like elements are denoted by like reference numerals and in which.

DETAILED DESCRIPTION OF THE PREFERRED EMBODIMENTS

Before discussing the present invention, liquid superheating and the subsequent occurrence of homogeneous nucleation will briefly be described.

It is known that the transient heat-transfer characteristics in any liquid depend strongly on the heating rate of a heating element immersed in the liquid. For very high heating rates, neither natural convection nor heterogeneous nucleation have time to develop, and the superheating of the liquid immediately adjacent to the heater surface takes place solely due to thermal conduction prior to the onset of homogeneous nucleation in the superheated liquid layer. Because of the short times involved, heterogeneous nucleation from the heater surface irregularities, such as grain boundaries, ledges, cracks, and scratches, does not have time to develop.

As a result of very rapid temperature rise, the liquid becomes highly superheated for short time periods and then induces homogeneous nucleation within a liquid layer (viz., activated liquid layer) adjacent to the heater surface.

The present invention discussed hereinlater is characterized in that an extremely high heating rate can be applied without any damage to a heater.

Figure 5A:
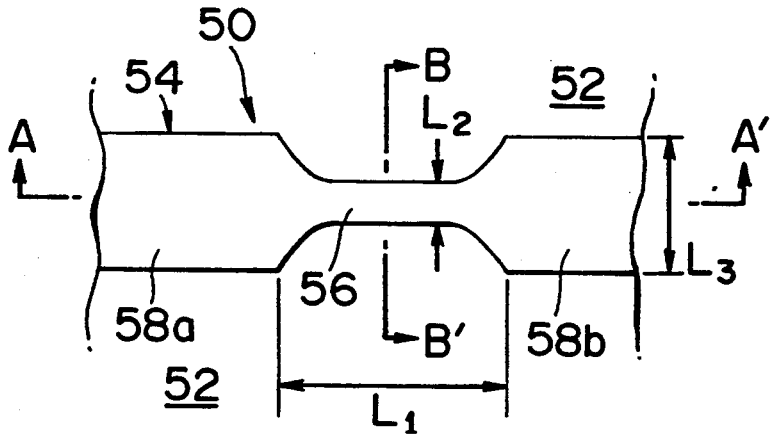
FIG. 5(A) is a plan view of a preferred embodiment of the present invention.
Figure 5B:
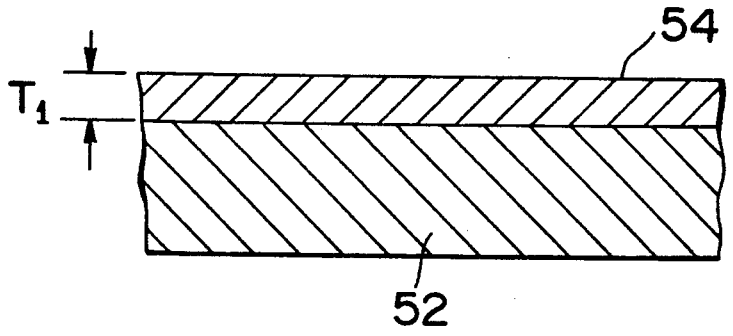
FIG. 5(B) is a sectional view taken along a section line A-A' of FIG. 5(A)
Figure 5C:
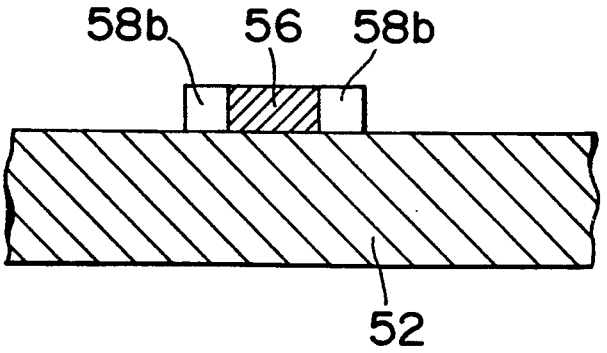
FIG. 5(C) is a cross sectional view taken along a section line B-B' of FIG. 5(A)

FIG. 5(A) is a plan view of an embodiment of the present invention wherein part of a heating arrangement 50 is illustrated. FIGS. 5(B) and 5(C) are sectional views taken along section lines A-A' and B-B' of FIG. 5(A), respectively.

In FIG. 5(A), the heater arrangement 50 is comprised of a substrate 52 and a thin film 54 which may be deposited thereon using sputtering, integrated circuit (IC) fabricating techniques or the like. The thin film 54 is divided into three sections: a heating element 56 and electrodes **58*a*, 58*b*. The substrate 52** is made of quartz glass which has a high glass transition temperature. As an alternative, non-alkali glass is also available such as a type "NA40" manufactured by Asahi Glass Corporation or a type "7059" by Corning Glass Corporation merely by way of example.

As mentioned above, the center portion of the thin film 54 serves as the heating element 56 to which a heating pulse is applied through the electrodes **58*a*, 58*b*. The thin film 54 has a thickness ($T_1$) ranging from 500 to 5000 Å. The heating element 56 has a length (L1) ranging from 10 to 500 μm and a width (L2) of from 10 to 50 μm, while each of the electrodes 58*a*, 58*b* provided at the both end of the heating element 56** has a width (L3) ranging from 100 to 500 μm.

The thin film 54 is made of alloy, oxides, nitrides or borides of titanium (Ti), tantalum (Ta), tungsten (W), niobium (Nb), chromium (Cr), hafnium (Hf), zirconium (Zr) and nickel (Ni), by way of example.

The heating element 56 has end portions which gradually and outwardly expand and are integrated with the corresponding ends of the electrodes 58*a*, 58*b*. This configuration enables heating currents to disperse in the vicinity of the boundaries of the heating element 56 and the electrodes 58*a*, 58*b*, so that undesirable thermal stresses induced in the heating element 56 can effectively be dispersed.

The heating element 56 and the electrodes 58*a*, 58*b* are formed by a single thin film of the same metal. In other words, there exists no laminated portions or interfaces of different metals at the boundaries between the heating element 56 and the electrodes 58*a*, 58*b* as in the prior art discussed above. Accordingly even if the heating element 56 is subjected to repeated applications of superheating pulses, cracks do not form at the boundaries of the heating element 56 and the electrodes 58*a*, 58*b*.

Figure 6A:
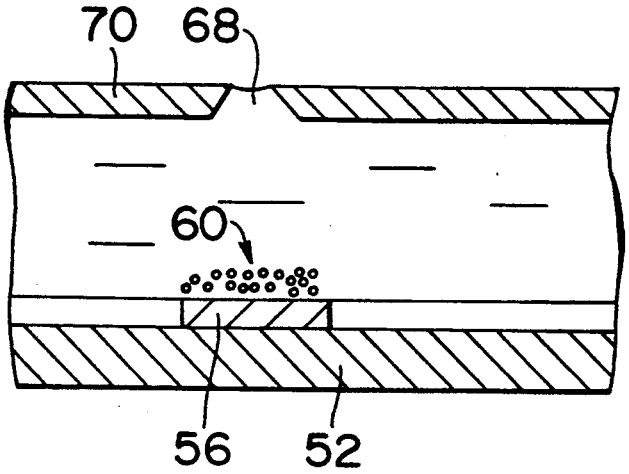
FIGS. 6(A) to 6(C) show the thermal excitation mechanism for explaining the present invention.
Figure 6B:
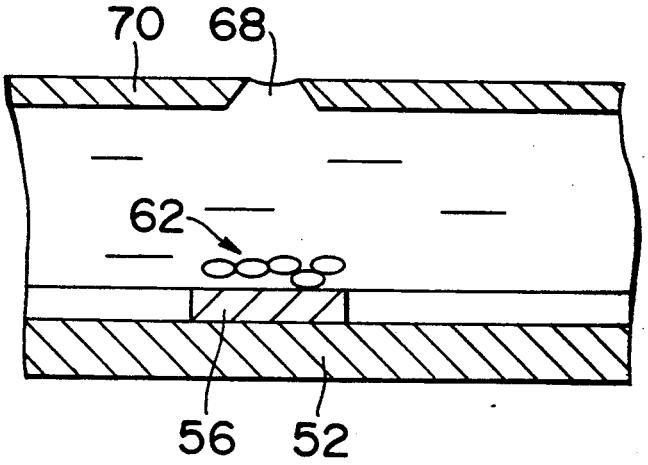
Figure 6C:
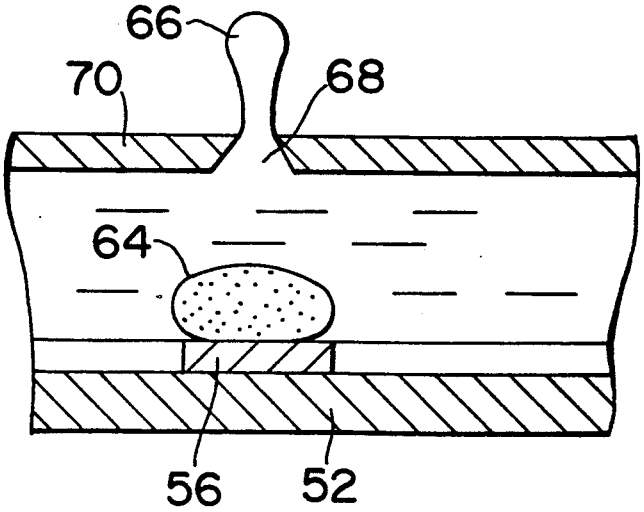

With the arrangement shown in FIG. 5(A), according to the inventors' experiments, the heater arrangement 50 suffered from no practical damages (viz., cracks) under the following conditions: (a) the heating element 56 was heated up at an extremely high rate in the range from $10^{6°}$ to $10^{9°}$ C./sec and (b) heat fluxes (viz., heat energy) were transferred from the surface of the heating element 56 to the liquid at a rate ranging from $10^7$ to $10^8$ MW (Mega Watt)/$m^2$. The time duration of each of the heating pulses applied to the heating element 56, was less than 10 $\mu$s. As illustratively shown in FIGS. 6(A), 6(B) and 6(C), it was observed that an infinitesimally thin vapor layer 60 covered the heating element 56 (viz., homogeneous or spontaneous nucleation) immediately after the heat pulse was applied, a plurality of small bubbles 62 formed (FIG. 6(B)) and agglomerated into a single bubble 64 (FIG. 6(C)) and resulted in the ejection of an ink droplet 66 through an orifice 68 formed in a plate 70. It is known in the art that such a sudden bubble growth under homogeneous nucleation causes droplets to be ejected at a high speed with high repetition rate.

Figure 1:
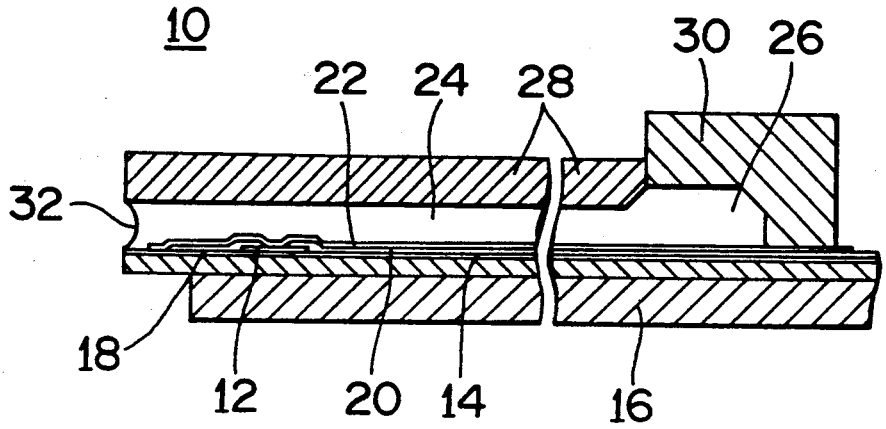
FIG.1 (PRIOR ART)
FIG. 1 is a sectional view of the known thermal ink-jet recording head referred to in the opening paragraphs of the instant specification.
Figure 2:
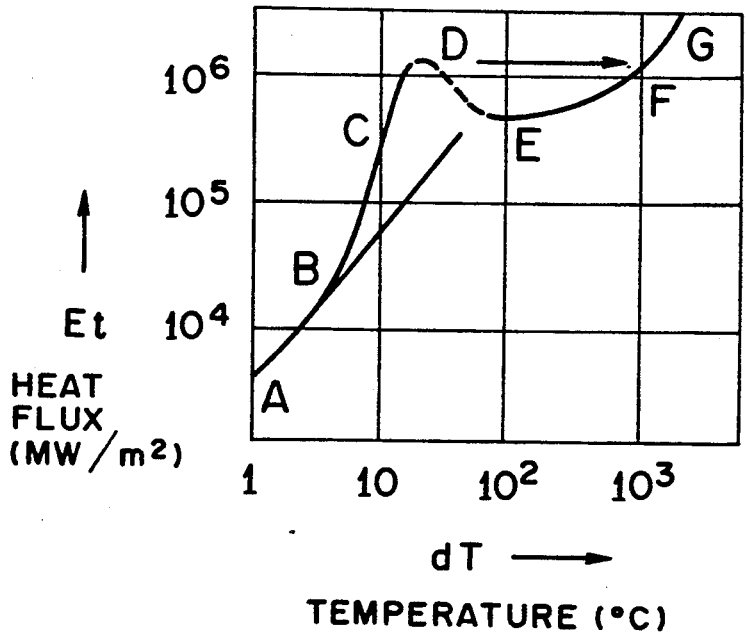
FIG.2 (PRIOR ART)
FIG. 2 is a plot of boiling curve describing the operation of the arrangement shown in FIG. 1.
Figure 3:
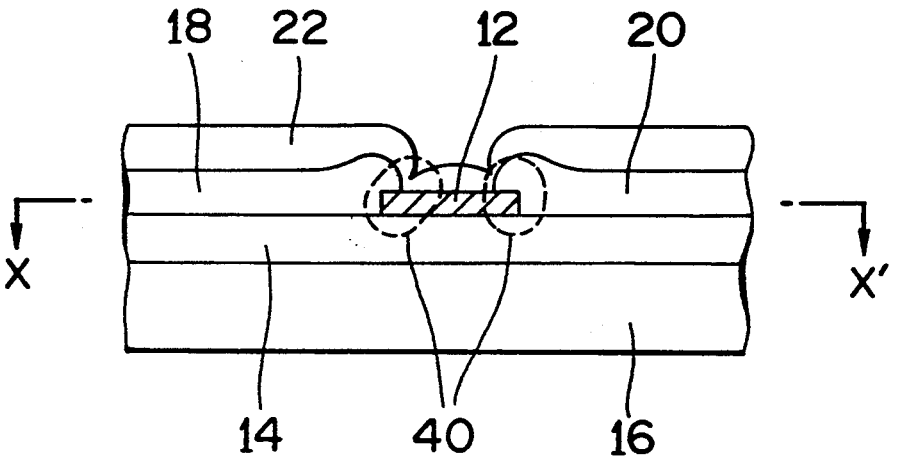
FIG. 3 (PRIOR ART)
FIG. 3 is an enlarged sectional view of a portion of the arrangement shown in FIG. 1.
Figure 4:
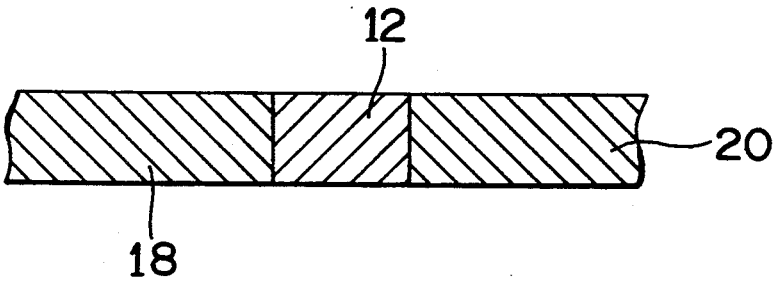
FIG. 4 (PRIOR ART)
FIG. 4 is a sectional view taken along a section line X-X' of FIG. 3.

In contrast, the inventors' experiments showed that the contact portions 40 of the prior art (FIG. 3) were subject to serious damages when such an extremely high heating rate is applied $10^4$ times to the heating element 12 with the same high heat flux transfer to the liquid as used in the above experiment.

Figure 7A:
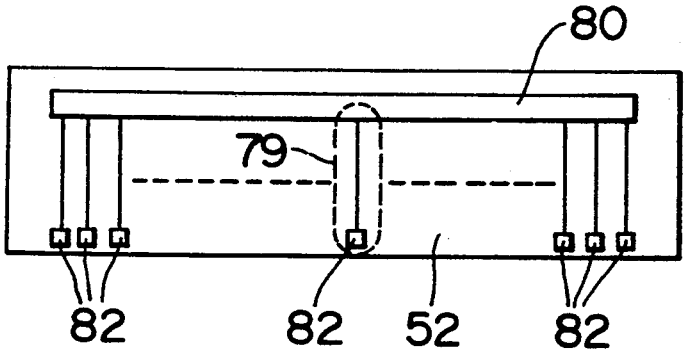
FIGS. 7(A) and 7(B) show an application of the present invention in the form of a ink-jet printhead for line printing.
Figure 7B:
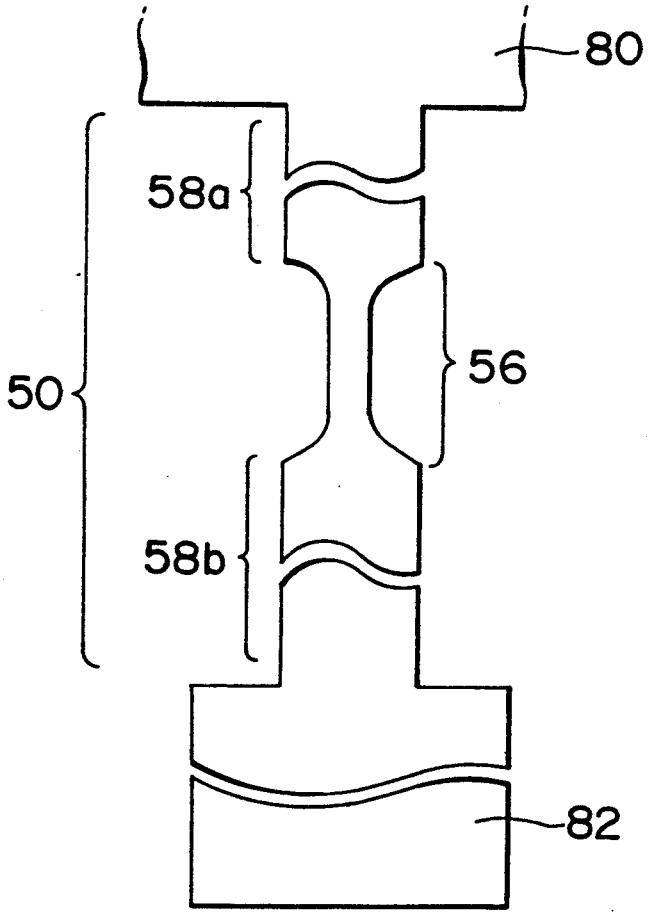

FIG. 7(A) is a plan view of an application of the present invention, while FIG. 7(B) is a close-up plan view of a portion 79 (enclosed by a broken line) of FIG. 7(A). This arrangement includes a plurality of the heater arrangements 50 (FIG. 5(A)) which are arrayed as shown on the substrate 52 and each of which has end portions coupled to a grounded conductive film 80 and an associated electrode pad 82. The pattern (of the heater arrangement 50 and the electrodes 80, 82), are formed on the substrate 52 using a conventional IC fabrication technique, sputtering or the like. An orifice plate (not shown), which is previously provided with a plurality of orifices, is positioned close to the substrate 52 such that: (a) the main surfaces thereof are parallel and (b) the orifices and the corresponding heating elements are aligned. For example, the orifice plate is provided with a plurality of spacers at suitable positions and also with elongated projections along the peripheries thereof for defining a space in combination with the substrate 52. The space is filled with a liquid (ink) supplied from a suitable liquid reservoir via a passage (both not shown). The number of the heating elements 56 provided on the substrate 52 is 200 to 300 per inch, for example.

With the above described construction, a line printing head for paper having a width of more than about 20 cm, can easily be produced at a relatively low cost.

The cross section of the orifices or nozzles used in combination with the inventive heater arrangement, may be a circular, however, the use of various other nozzle configurations such as those disclosed in Japanese patent applications provisionally published under publication Nos. 62-253456, 63-182152, 63-197653, 63-27257, 1-97654 and 2-76744, are within the scope of the present invention. Particularly, the orifice plate with an array of slit nozzles, such as disclosed in the above-mentioned provisional publications 62-253456, 63-182152 and 1-97654, is suitable for alignment of a nozzle and the corresponding inventive heater arrangement.

As mentioned above, the heater arrangement 50 can be prepared by conventional IC processes and hence manufacturing costs are very low. Accordingly, a disposable line printing head can be realized. Thus, the nozzle blocking problem which is inherent with ink-jet type printers can be solved through the use of what can be looked upon as being a disposable printhead.

The heater arrangement 50 is preferably covered with ink-resistance passivation film of $SiO_2$ or $Si_3N_4$ with a thickness ranging from 1000 to 50000 Å. As an alternative, a protective film of Au or Pt may be provided on the heater arrangement 50.

Figure 8:
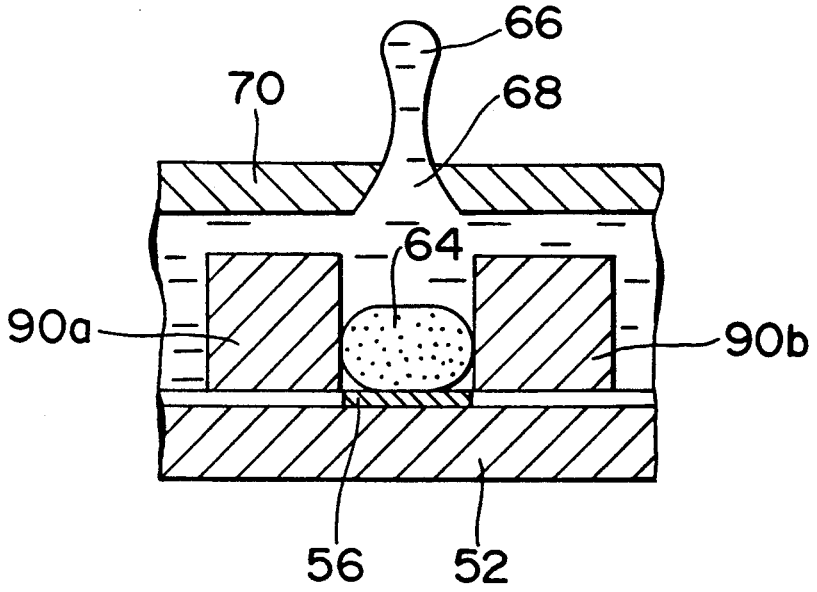
FIG. 8 is a cross sectional view for showing a variant of the present invention wherein a pair of pressure walls is provided at both side of a heating element.

FIG. 8 is a cross sectional view of a modification of the present invention. As shown, a pair of pressure walls 90*a*, 90*b* is provided for effectively directing pressure waves caused by bubble growth toward the nozzle 68. The provision of such pressure walls in a thermal ink-jet type printhead, has been disclosed in Japanese patent application No. 62-108333 provisionally published under publication No. 63-272557 on Nov. 10, 1988. The walls are made of photo-sensitive polyimide resin and deposited on the substrate 52 using photolithography, for example.

While the foregoing description describes one type of heater construction, the various alternatives and modifications possible without departing from the scope of the present invention, which is limited only by the appended claims, will be apparent to those skilled in the art.

What is claimed is:

1. In a method of operating a thermal ink-jet type print head which includes a substrate, a strip-like thin metallic layer formed on said substrate, said strip-like thin metallic layer being configured so as to define the narrow portion which is located between broad portions, the narrow portion defining a heating element which is integral with the broad portions which act as electrodes via which currents are supplied to the narrow heater portion, the steps of:

applying a current to the heating element in a manner to heat the same in a range from $10^{6°}$ to $10^{9°}$ C./sec so as to transfer heat energy from the heating element to an ink at a rate of $10^7$ to $10^8$ MW/$m^2$ over a time period less than 10 $\mu$s and to achieve homogenous nucleation via which a bubble of gas is produced and induces a droplet of ink to be ejected from a nozzle located adjacent the heating element.

2. A method as claimed in claim 1, wherein said narrow portion has end portions which gradually and outwardly expand and are integrated with the broad portions.

* * * * *